US010047982B2

(12) United States Patent
Song et al.

(10) Patent No.: US 10,047,982 B2
(45) Date of Patent: Aug. 14, 2018

(54) ICE STORAGE APPARATUS AND ICE MAKING APPARATUS COMPRISING SAME

(71) Applicant: COWAY CO., LTD., Chungcheongnam-do (KR)

(72) Inventors: Min-Sub Song, Seoul (KR); Jung-Chul Park, Seoul (KR); Yong-Yeon Noh, Seoul (KR); Do-Han Kim, Seoul (KR); Si-Jun Park, Seoul (KR); Gyeong-Min Lee, Seoul (KR)

(73) Assignee: Coway Co., Ltd. (KR)

( * ) Notice: Subject to any disclaimer, the term of this patent is extended or adjusted under 35 U.S.C. 154(b) by 0 days.

(21) Appl. No.: 15/031,946

(22) PCT Filed: Nov. 6, 2014

(86) PCT No.: PCT/KR2014/010596
§ 371 (c)(1),
(2) Date: Apr. 25, 2016

(87) PCT Pub. No.: WO2015/069027
PCT Pub. Date: May 14, 2015

(65) Prior Publication Data

US 2016/0282030 A1 Sep. 29, 2016

(30) Foreign Application Priority Data

Nov. 6, 2013 (KR) ..... 10-2013-0134130
Nov. 4, 2014 (KR) ..... 10-2014-0152062

(51) Int. Cl.
*F25B 21/02* (2006.01)
*F25C 1/08* (2006.01)
*F25C 5/185* (2018.01)

(52) U.S. Cl.
CPC ..... *F25B 21/02* (2013.01); *F25C 1/08* (2013.01); *F25C 5/185* (2013.01); *F25B 2500/12* (2013.01)

(58) Field of Classification Search
CPC .... F25C 5/185; F25C 1/08; F25C 1/22; F25C 1/04; F25C 5/18; F25B 2500/12; F25B 21/02
USPC ..... 62/3.63
See application file for complete search history.

(56) References Cited

U.S. PATENT DOCUMENTS

2011/0036115 A1* 2/2011 Lee ..... F25C 1/08 62/344

FOREIGN PATENT DOCUMENTS

| | | |
|---|---|---|
| JP | 10-038426 | 2/1998 |
| KR | 1094805 | 12/2011 |
| KR | 2012-0083127 | 7/2012 |
| KR | 2012-0097070 | 9/2012 |
| KR | 2012-0110736 | 10/2012 |

* cited by examiner

*Primary Examiner* — Ana Vazquez
(74) *Attorney, Agent, or Firm* — The Farrell Law Firm, P.C.

(57) ABSTRACT

Disclosed is an ice storage apparatus that may include an ice reservoir having ice stored therein, the ice being made in an ice making unit, and a noise reduction unit for reducing noise transmitted externally when the ice is moved from the ice making unit to the ice reservoir.

8 Claims, 7 Drawing Sheets

【Figure 1】
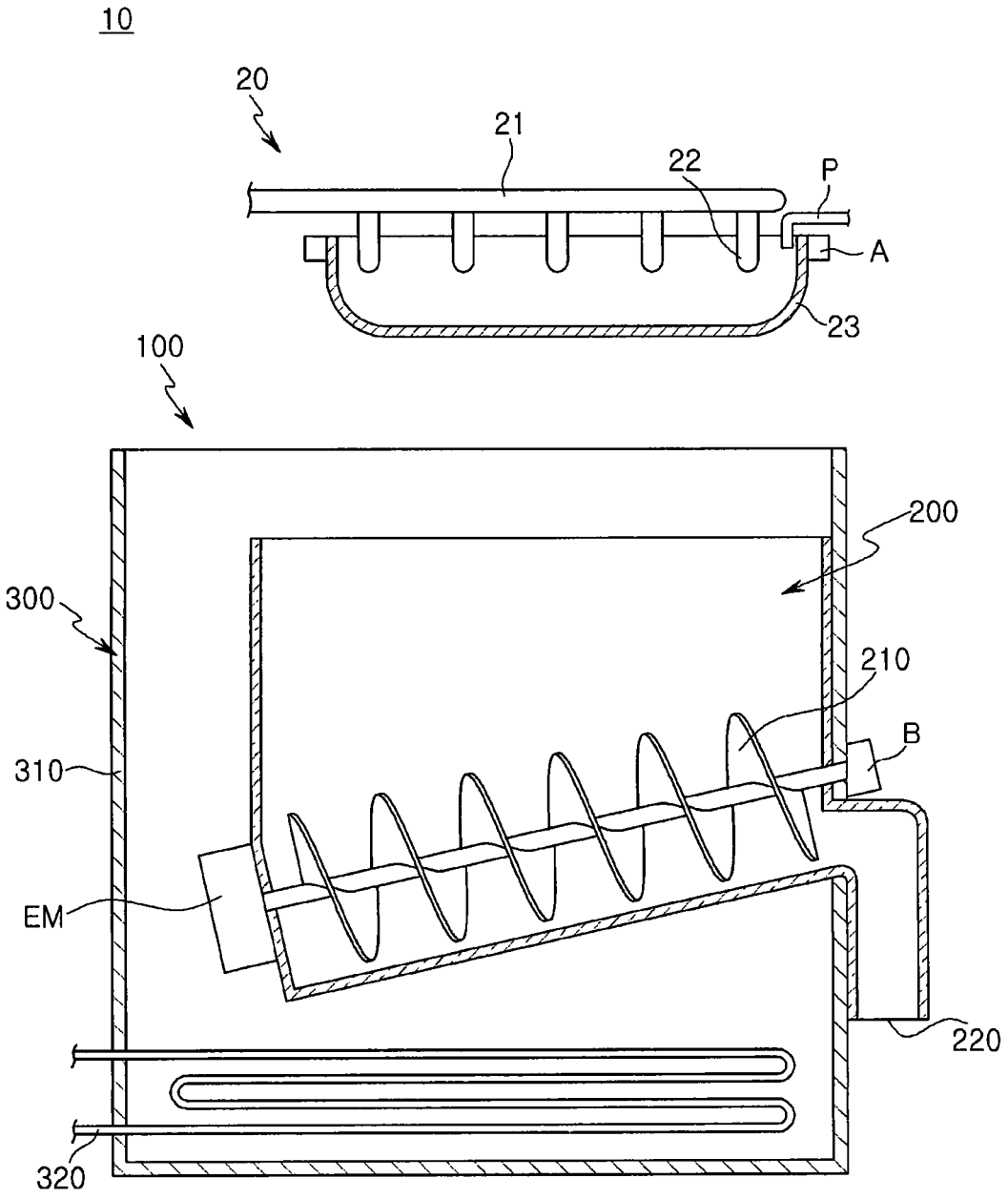

【Figure 2】
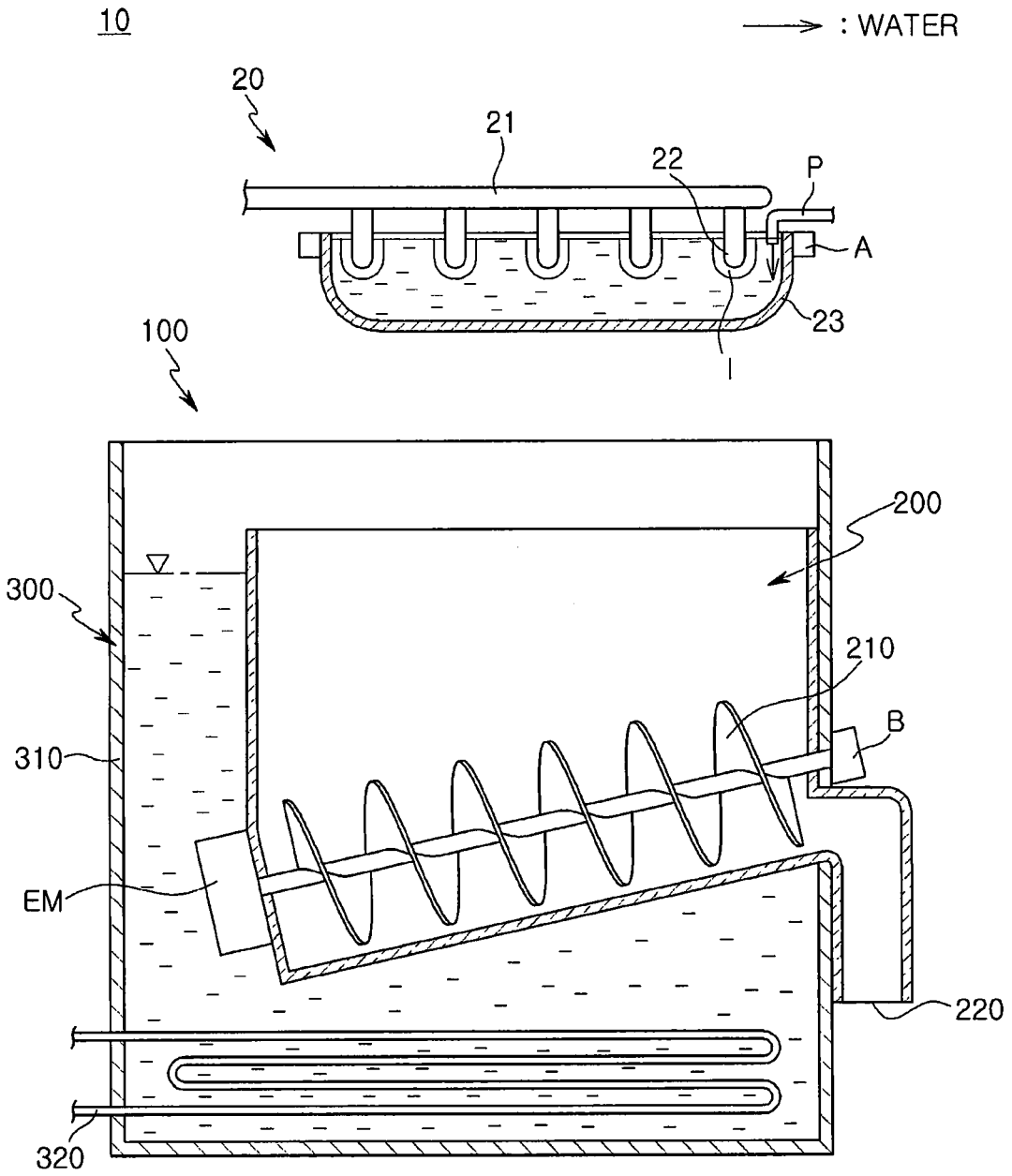

【Figure 3】
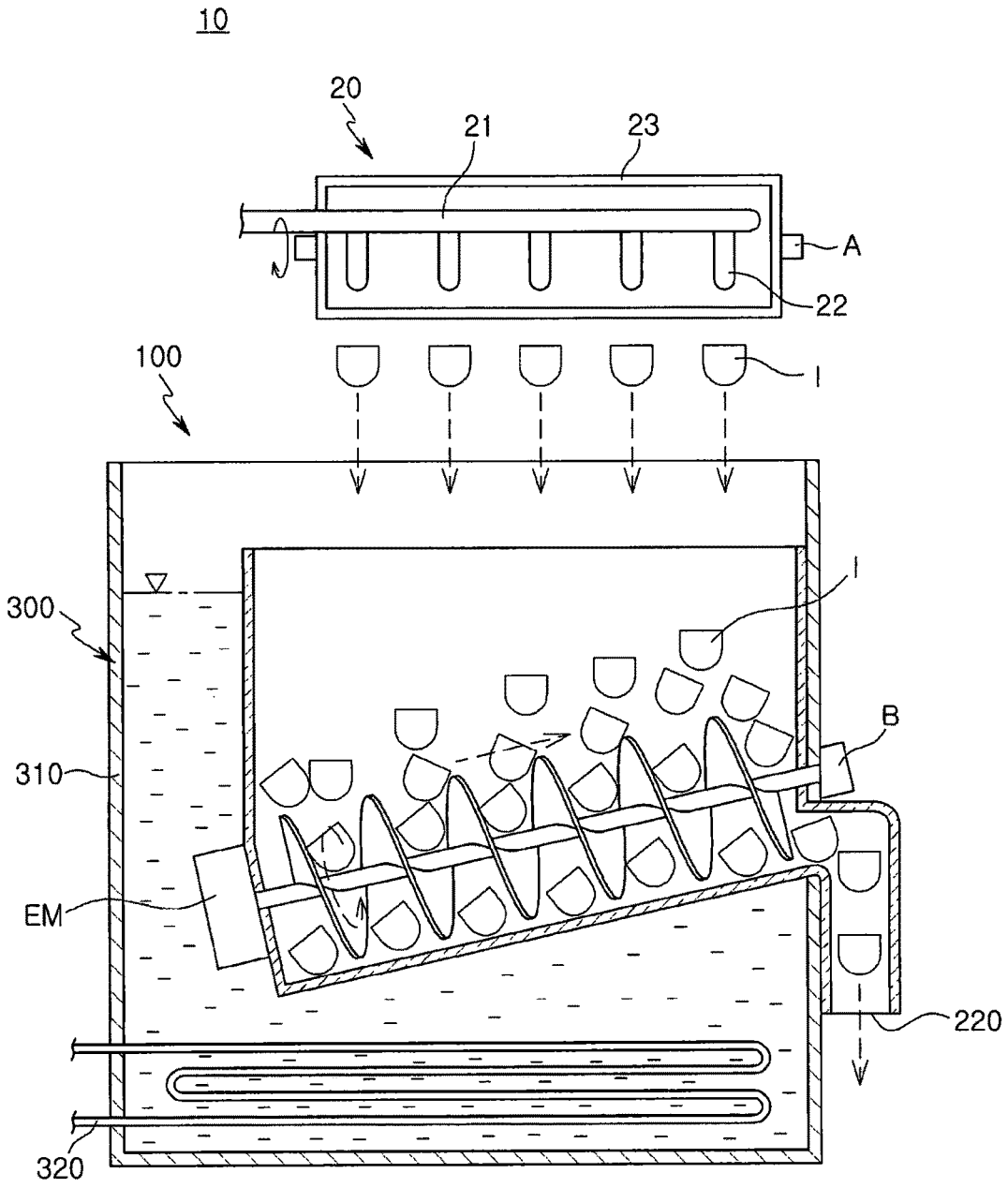

【Figure 4】
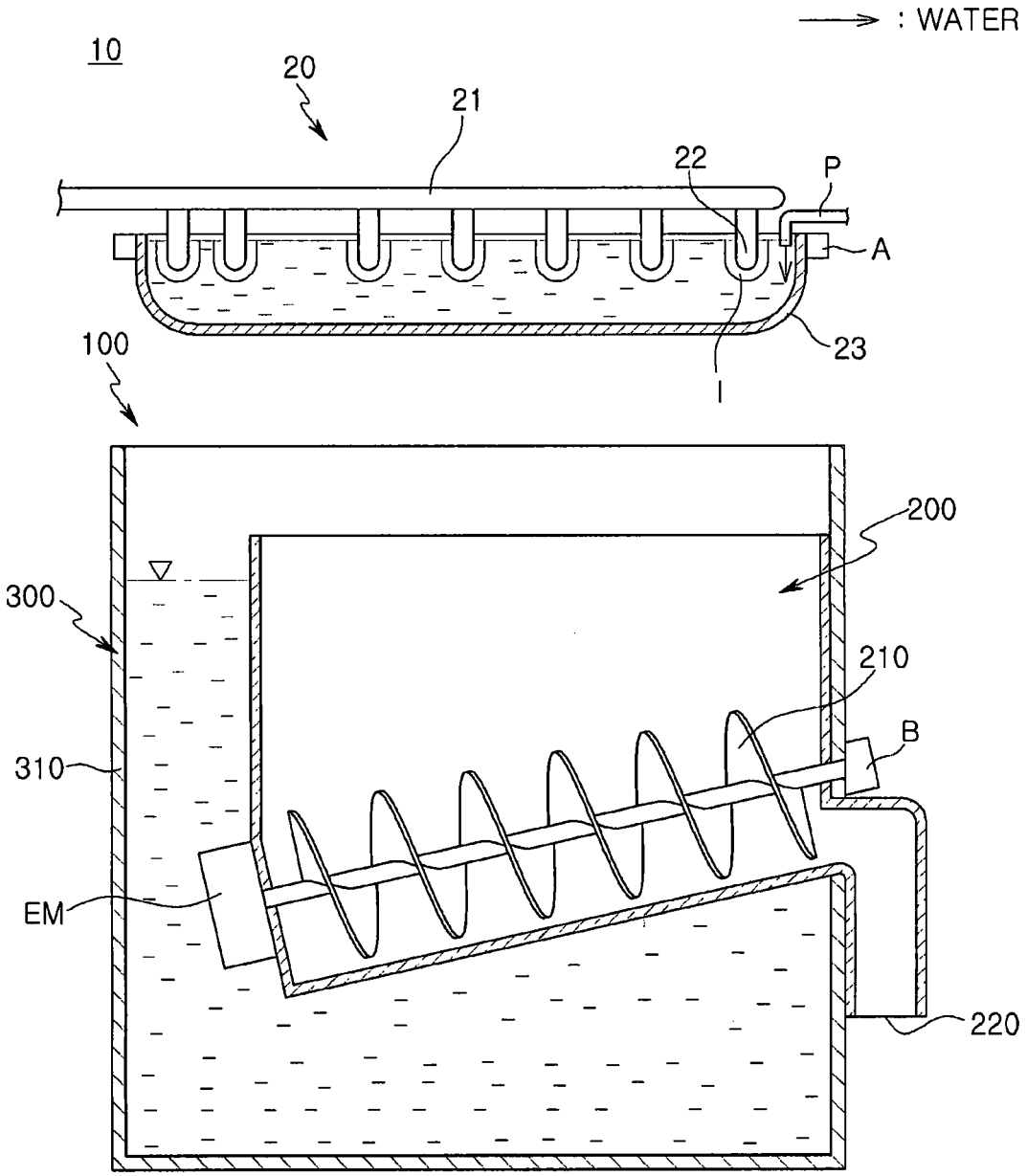

【Figure 5】
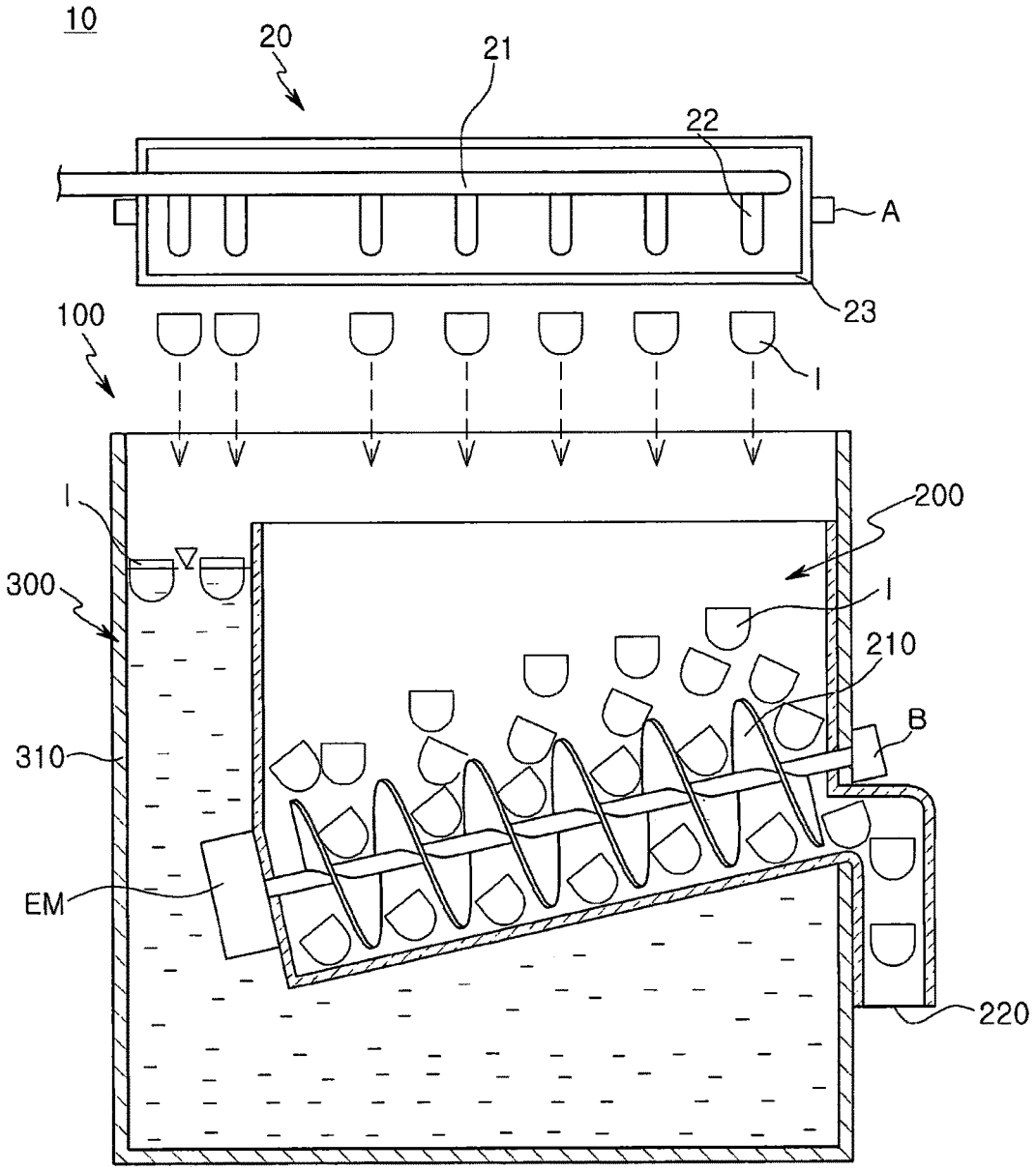

【Figure 6】
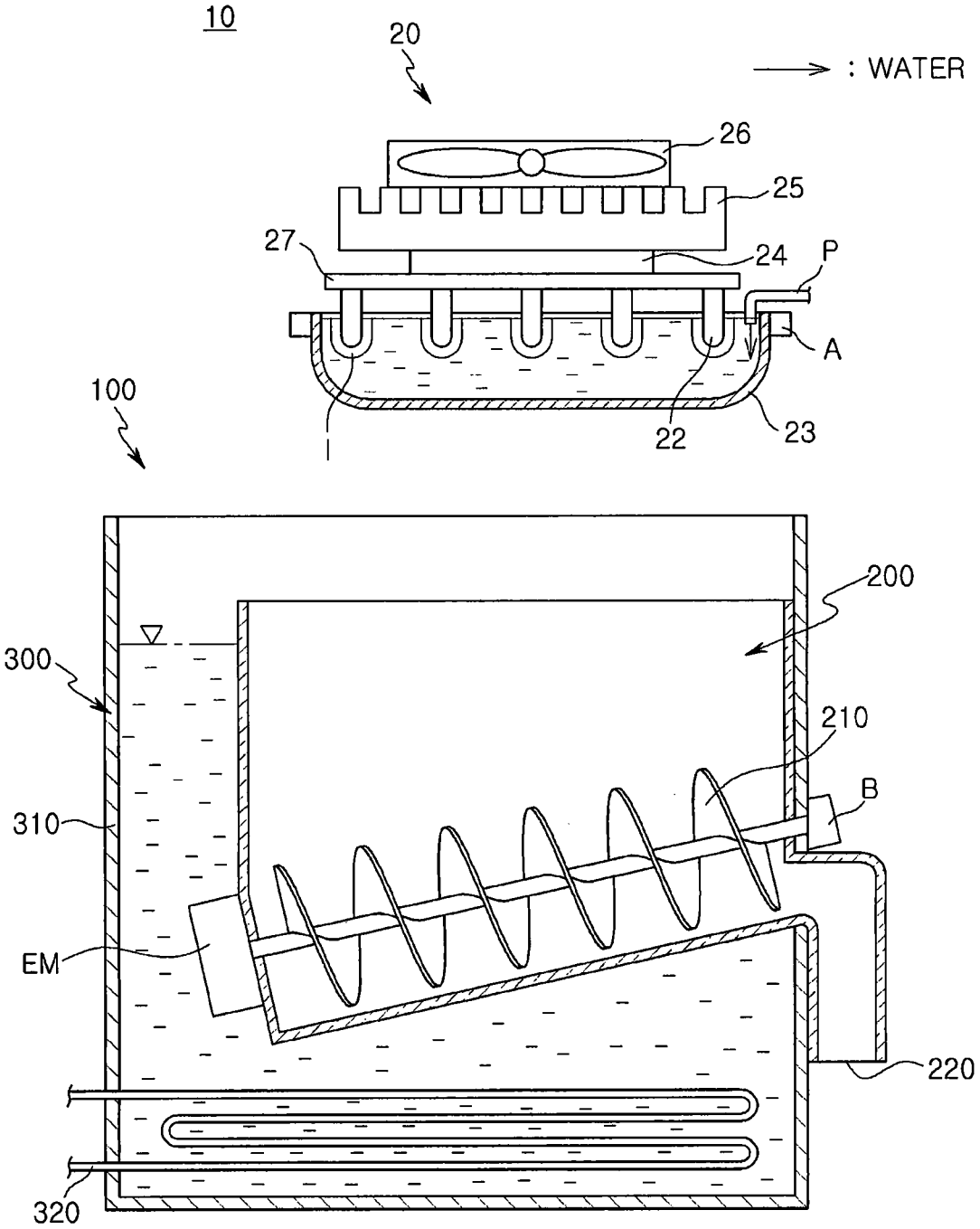

【Figure 7】
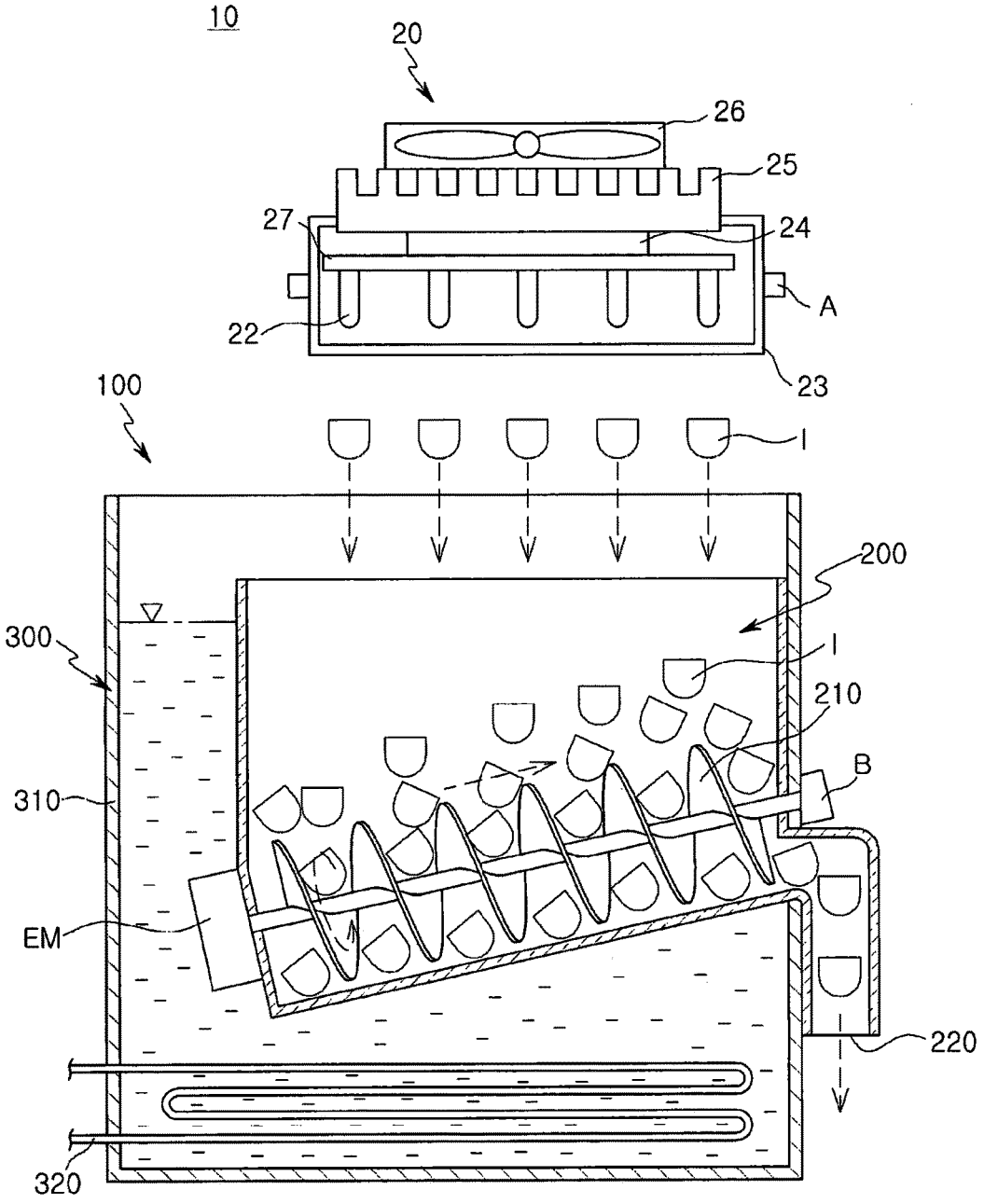

ICE STORAGE APPARATUS AND ICE MAKING APPARATUS COMPRISING SAME

PRIORITY

This application is a National Phase Entry of PCT International Application No. PCT/KR2014/010596, which was filed on Nov. 6, 2014, and claims priority to Korean Patent Application No. 10-2013-0134130, which was filed on Nov. 6, 2013, and Korean Patent Application No. 10-2014-0152062, which was filed on Nov. 4, 2014, the contents of each of which are incorporated herein by reference.

TECHNICAL FIELD

The present disclosure relates to an ice storage apparatus storing ice produced by an ice making unit and an ice making apparatus comprising the same, and more particularly, to an ice storage apparatus capable of reducing noise transmitted externally when ice is moved from an ice making unit to an ice reservoir included in the ice storage apparatus and storing ice, and an ice making apparatus including the same.

BACKGROUND ART

An ice making apparatus is an apparatus for producing ice. An ice making apparatus commonly includes an ice making unit that produces ice. The ice making unit may be classified as an immersion-type ice making unit including an immersion member which is cooled in a state of being immersed in water to produce ice thereon, a jetting-type ice making unit producing ice by jetting water into a cooled ice making tray, and a flow-through-type ice making unit causing water to flow into a cooled ice making tray to produce ice.

Also, the ice making apparatus includes an ice reservoir. The ice reservoir has a storage space in which ice is stored. Ice produced in the ice making unit is moved to the ice reservoir and stored in the storage space.

Ice produced in the ice making unit may be dropped due to self-load to move to the ice reservoir. Thus, when ice moves to the ice reservoir, it may collide with the ice reservoir or other ice stored in the ice reservoir. That is, when ice moves, noise occurs.

Noise that occurs when the ice is moved is transmitted externally through the ice reservoir and the ice making apparatus. However, in the related art, noise transmitted externally when ice is moved is not reduced.

In addition, when heat is transmitted to the ice stored in the ice reservoir, the ice melts to be changed in size or shape.

DISCLOSURE

Technical Problem

The present disclosure is based upon recognition of the requirements and issues arising from the above-referenced related art ice storage apparatus and the ice making apparatus including the same.

An aspect of the present disclosure is to reduce noise transmitted externally when ice is moved from an ice making unit in which ice is produced to an ice reservoir in which ice is stored.

Another aspect of the present disclosure is to restrain ice stored in an ice reservoir from being easily changed in size or shape due to heat transmitted to ice.

Technical Solution

An ice storage apparatus and an ice making apparatus including the same related to exemplary embodiments for realizing at least one of the technical problems may include the following features.

According to an aspect of the present invention, there is provided an ice storage apparatus including: an ice reservoir storing ice produced in an ice making unit; and a noise reduction unit reducing noise transmitted externally when ice is moved from the ice making unit to the ice reservoir.

The noise reduction unit may include a tank, in which at least a portion of the ice reservoir is positioned, storing a liquid having a predetermined level for attenuating noise.

The liquid may be water.

The tank may be a cold water tank in which cold water is stored.

The tank may include a cooling unit cooling water.

A portion of ice produced in the ice making unit may be supplied to the tank to produce cold water.

According to another aspect of the present invention, there is provided an ice making apparatus including: an ice making unit producing ice; and the aforementioned ice storage apparatus storing ice produced by the ice making unit.

The ice making unit may include: an evaporator in which a refrigerant flows; an immersion member connected to the evaporator; and an ice making tray in which water is held to allow the immersion member to be immersed therein.

The ice making unit may include: a thermoelectric module in which heat is transmitted from one side thereof to the other side thereof when power is applied thereto; an immersion member connected to the thermoelectric module; and an ice making tray in which water is held to allow the immersion member to be immersed therein.

Advantageous Effects

According to exemplary embodiments of the present disclosure, since the noise reduction unit is provided, noise transmitted externally when ice is moved from the ice making unit in which ice is produced to the ice reservoir in which ice is stored may be reduced.

Also, according to exemplary embodiments of the present disclosure, heat transmission to ice stored in the ice reservoir is minimized, and thus, a size or a shape of pieces of ice may not be easily changed.

BRIEF DESCRIPTION OF DRAWINGS

FIG. 1 is a view illustrating an ice storage apparatus and an ice making apparatus including the same according to an exemplary embodiment in the present disclosure;

FIGS. 2 and 3 are views illustrating operations of an ice storage apparatus and an ice making apparatus including the same according to an exemplary embodiment in the present disclosure;

FIGS. 4 and 5 are views illustrating operations of an ice storage apparatus and an ice making apparatus including the same according to another exemplary embodiment in the present disclosure; and FIGS. 6 and 7 are views illustrating an ice making apparatus and an operation thereof according to another exemplary embodiment in the present disclosure.

BEST MODES

To help understand the foregoing features of the present disclosure, an ice making apparatus and an ice making apparatus including the same related to exemplary embodiments of the present disclosure will be described in detail with reference to the accompanying drawings.

Hereinafter, exemplary embodiments most appropriate to help in an understanding of the technical features of the present disclosure will be described, the technical features of the present disclosure are not limited by the described exemplary embodiments and merely illustrate the implementation of the present disclosure through the exemplary embodiments described hereinafter. Thus, the present disclosure can be variably modified within the scope of the present disclosure through the exemplary embodiments described below, and such modifications are within the scope of the present disclosure. In order to help understand the exemplary embodiments described hereinafter, the like or similar reference numerals are used for relevant components among the components having the same function in the respective exemplary embodiments in the accompanying drawings.

FIG. 1 is a view illustrating an ice storage apparatus and an ice making apparatus including the same according to an exemplary embodiment in the present disclosure, and FIGS. 2 and 3 are views illustrating operations of an ice storage apparatus and an ice making apparatus including the same according to an exemplary embodiment in the present disclosure.

As illustrated in FIGS. 1 through 3, an ice storage apparatus according to an exemplary embodiment in the present disclosure may include an ice reservoir 200 and a noise reduction unit 300.

The ice reservoir 200 may store ice I produced in an ice making unit 20. As illustrated in FIGS. 1 through 3, the ice reservoir 200 may have a storage space in which ice I is stored. An upper portion of the ice reservoir 200 may be open.

Thus, as illustrated in FIG. 3, the ice I produced in the ice making unit 20 may be dropped by gravitational force and introduced to the ice reservoir 200 through an open upper portion of the ice reservoir 200. The ice may then be stored in the storage space of the ice reservoir 200.

However, the configuration in which ice I produced in the ice making unit 20 is moved to and stored in the ice reservoir 200 is not limited to the example described above and any other known configuration such that based on an ice transfer path (not shown) connected to the ice making unit 20 and the ice reservoir 200 may also be adopted.

As illustrated in FIGS. 1 through 3, an ice transfer member 210 may be provided in the ice reservoir 200. Ice I stored in the ice reservoir 200 may be discharged outwardly through an ice discharge opening 220 provided in the ice reservoir 200 by the ice transfer member 210.

The ice transfer member 210 may be rotatably provided in the ice reservoir 200. To this end, one side of the ice transfer member 210 may be connected to a driving motor EM provided in the ice reservoir 200. The other side of the ice transfer member 210 may be rotatably connected to a rotation support portion B provided in the ice reservoir 200 on the opposite side of the driving motor EM. When the driving motor EM is driven, the ice transfer member 210 may be rotated.

As illustrated in FIGS. 1 through 3, the driving motor EM may be provided in the ice reservoir 200 in such a manner that the driving motor EM is positioned within a tank 310 (to be described hereinafter) included in the noise reduction unit 300. Also, the rotation support portion B may be provided outside of the tank 310.

In such a case, the driving motor EM may have a structure in which a liquid stored in the tank 310 is not introduced to the driving motor EM.

In addition, the rotation support portion B may be provided in the ice reservoir 200 such that the rotation support portion B is positioned within the tank 310, and the driving motor EM may be provided outside of the tank 310. In this case, the rotation support portion B may have a structure in which a liquid stored in the tank 310 is not introduced to the rotation support portion B.

As illustrated in FIGS. 1 through 3, the ice transfer member 210 may have a screw shape. Thus, when the ice transfer member 210 is rotated, ice I stored in the ice reservoir 200 may be moved toward the ice discharge opening 220 along the ice transfer member 210. The ice I moved to the ice discharge opening 220 may be discharged outwardly through the ice discharge opening 220 as illustrated in FIG. 3.

However, the shape of the ice transfer member 210 is not particularly limited and any other known shape may be adopted as long as it allows the ice I stored in the ice reservoir 200 to be moved toward the ice discharge opening 220 and subsequently discharged through the ice discharge opening 220. As illustrated in FIGS. 1 through 3, a lower surface of the ice reservoir 200 may be sloped to rise in a direction toward the ice discharge opening 220. Through this configuration, even in the case that ice I accumulates excessively on the ice discharge opening 220 side, while moving toward the ice discharge opening 220 by the ice transfer member 210, a portion of the ice I may be moved to the opposite side due to weight thereof. Thus, the ice discharge opening 220 may be prevented from being stopped by ice I due to excessive accumulation of the ice I on the ice discharge opening 220 side.

The noise reduction unit 300 may reduce noise transmitted externally when the ice I is moved from the ice making unit 20 to the ice reservoir 200.

To this end, as illustrated in FIGS. 1 through 3, the noise reduction unit 300 may include the tank 310. At least a portion of the ice reservoir 200 may be positioned within the tank 310. As illustrated, the ice reservoir 200 may be positioned within the tank 310 such that the ice discharge opening 220 is exposed externally. Accordingly, the ice I stored in the ice reservoir 200 may be discharged externally through the ice discharge opening 220. The ice reservoir 200 may be positioned such that at least a portion thereof is present within the tank 310 using a rib (not shown).

However, the configuration in which at least a portion of the ice reservoir 200 is positioned within the tank 310 is not particularly limited and any other known configuration in which a portion of the ice reservoir 200 is positioned within the tank 310 by a separate support member (not shown) may also be adopted.

As illustrated in FIGS. 2 and 3, a liquid attenuating noise and having a predetermined level may be stored within the tank 310. To this end, the tank 310 may be connected to a liquid source (not shown) by a connection pipe (not shown). Here, water from the liquid source may be supplied to the tank 310 by opening an opening and closing valve (not shown) provided in the connection pipe.

As described above, the ice I produced in the ice making unit 20 is dropped by weight thereof and moved to and stored in the ice reservoir 200. While the ice I is dropped and moving, the ice I may collide with the ice reservoir 200 or another ice I stored in the ice reservoir 200, and noise may be produced accordingly.

The produced noise may be transmitted externally through the liquid stored in the tank 310 and attenuating noise. That is, noise may be transmitted externally through a wall of the ice reservoir 200 as a solid, the liquid stored in the tank 310, and the tank 310 as a solid.

Meanwhile, sound waves are transferred more slowly in a medium in which a distance between particles is greater. That is, a transmission speed of sound waves in a liquid is slower than that of sound waves in a solid. Thus, the aforementioned noise may be attenuated, while a speed thereof is reduced, when passing through the liquid stored in the tank 310. Accordingly, noise transmitted externally may be reduced.

The liquid stored in the tank 310 may be water. However, the liquid stored in the tank 310 may be any liquid through which noise may be attenuated while passing therethrough, rather than being limited to water.

In this manner, when the liquid stored in the tank 310 is water, a liquid source connected to the tank 310 may be the same as a water source (not shown) connected to a water supply pipe P supplying water to an ice making tray 23 (to be described hereinafter).

The tank 310 may be a cold water tank in which cold water is stored. Sound waves are transmitted more slowly when a temperature is lower even in case of the same medium. Thus, when cold water is stored in the tank 310, noise may be more effectively attenuated, and thus, noise transmitted externally may be further reduced.

Also, when the tank 310 included in the noise reduction unit 300 is a cold water tank, a temperature difference between the ice I stored in the ice reservoir 200 and the cold water stored in the cold water tank is small, minimizing a heat transfer rate transferred to the ice I stored in the ice reservoir 200 from the outside.

That is, ambient heat may be first transferred to cold water stored in the tank 310, a cold water tank. However, since a temperature of the cold water is so low that a degree of a temperature increase of cold water stored in the tank 310 due to heat transmission from the outside is small. Thus, even in the case that heat is transmitted from the outside, a temperature difference between cold water stored in the tank 310 as a cold water tank and the ice I stored in the ice reservoir 200 is small.

Thus, a heat transfer rate transferred from the cold water stored in the tank 310 as a cold water tank to the ice I stored in the ice reservoir 200 may be minimized. Accordingly, the ice I stored in the ice reservoir 200 is prevented from being melted due to heat transmission and thus readily changed in shape and size.

Also, the tank 310 as a cold water tank may only receive heat from the exterior and transfer heat to the ice reservoir 200, a temperature rise rate of cold water stored in the tank 310 may be minimized. Thus, cold water production efficiency in the tank 310 as a cold water tank may be increased.

As illustrated in FIG. 1, the tank 310 may include a cooling unit 320. Water stored in the tank 310 may be cooled by the cooling unit 320 to become cold water. The cooling unit 320 may be an evaporator in which a cold refrigerant flows, for example.

However, the cooling unit 320 is not particularly limited and any other known cooling unit including a thermoelectric module in which heat is transferred from one side to the other side when power is applied thereto may be adopted as long as it can cool water stored in the tank 310 to produce cold water.

As illustrated in FIGS. 1 through 3, the ice making apparatus 100 according to an exemplary embodiment may include the ice making unit 20 and the aforementioned ice storage apparatus 100.

Ice I may be produced in the ice making unit 20. To this end, the ice making unit 20 may include an evaporator 21, an immersion member 22, and the ice making tray 23.

The evaporator 21 may form a refrigerating cycle together with a compressor (not shown), a condenser (not shown), and an expansion valve (not shown) or a capillary pipe (not shown). In the refrigerating cycle, a refrigerant may flow, while being changed in temperature, pressure, and phase. Also, in the evaporator 21, a cold refrigerant having a temperature lower than that of a freezing point of water flows. Thus, as illustrated in FIG. 2, ice I may be produced in the immersion member 22 connected to the evaporator 21.

A hot refrigerant may also flow in the evaporator 21. For example, when a refrigerant is compressed by the compressor to have a high temperature and subsequently bypassed to flow to the evaporator 21, the hot refrigerant may flow in the evaporator 21. Accordingly, as illustrated in FIG. 3, ice I produced in the immersion member 22 may be separated from the immersion member 22.

Alternatively, a separate heater (not shown) may be provided in the evaporator 21 and the immersion member 22 may be heated by operating the heater, whereby the ice I produced in the immersion member 22 may be separated from the immersion member 22.

The immersion member 22 may be connected to the evaporator 21. The immersion member 22 may be connected to the evaporator 21 such that a refrigerant flowing in the evaporator 21 may also flow to the immersion member 22. Accordingly, when a cold refrigerant flows in the evaporator 21, the immersion member 22 may be cooled, and when a hot refrigerant flows in the evaporator 21, the immersion member 22 may be heated.

The ice making tray 23 may be filled with water such that the immersion member 22 is immersed in the water. As illustrated in FIG. 2, water may be supplied to the ice making tray 23 by the water supply pipe P connected to a water source (not shown). Accordingly, the immersion member 22 may be immersed in water held in the ice making tray 23.

When the ice making apparatus 10 according to an exemplary embodiment is provided in a water treatment apparatus (not shown) such as a water purifier, or the like, the water source to which the water supply pipe P is connected may be a filtering unit included in the water treatment apparatus and including a water purifying filter filtering water or a storage tank connected to the filtering unit and storing filtered water.

However, the water source to which the water supply pipe P is connected is not particularly limited and any other known water source may be adopted as long as it can supply water to the water supply pipe P.

The ice making tray 23 may be rotated around a rotational shaft A between an ice making position in which water is held in the ice making tray 23 as illustrated in FIG. 2 and an ice removing position in which water cannot be held in the ice making tray 23 as illustrated in FIG. 3.

When the ice making tray 23 is rotated to the ice making position, water supplied through the water supply pipe P may be held in the ice making tray 23 as illustrated in FIG. 2. Accordingly, the immersion member 22 may be immersed in water held in the ice making tray 23.

In this state, when a cold refrigerant flows in the evaporator 21, the cold refrigerant flowing in the evaporator 21 or the immersion member 22 and water held in the ice making tray 23 may be heat-exchanged to produce ice I in the immersion member 22 as illustrated in FIG. 2.

When the ice I produced in the immersion member 22 has a predetermined size, the ice making tray 23 is rotated to the ice removing position as illustrated in FIG. 3. In this state, a hot refrigerant may be allowed to flow in the evaporator 21 or a heater provided in the evaporator 21 is operated. Accordingly, the ice I produced in the immersion member 22 may be separated from the immersion member 22 and, as illustrated in FIG. 3, the ice I is dropped due to weight thereof so as to be stored in the ice reservoir 200.

However, a configuration of the ice making unit 20 is not particularly limited and any other known configuration such as a jetting-type ice maker producing ice by jetting water to an ice making tray cooled to have a temperature lower than a freezing point by an evaporator, or the like, or a flow-through-type ice maker causing water to flow in an ice making tray cooled to have a temperature lower than a freezing point to produce ice may be adopted as long as it can produce ice I.

The ice storage apparatus 100 has been described, so a description thereof will be omitted.

FIGS. 4 and 5 are views illustrating operations of an ice storage apparatus and an ice making apparatus including the same according to another exemplary embodiment in the present disclosure.

An ice storage apparatus 100 and an ice making apparatus 10 according to another exemplary embodiment are different from the Ice storage apparatus 100 and the ice making apparatus 10 described above with reference to FIGS. 1 through 3, in that a portion of ice I produced in the ice making unit 20 is supplied to the tank 310 to produce cold water. Thus, different components will be mainly described, and descriptions of other components may be replaced with those made above with reference to FIGS. 1 through 3.

A portion of ice I produced in the ice making unit 20 of the ice making apparatus 10 may be supplied to a tank 310 of the ice storage apparatus 100 according to another exemplary embodiment to produce cold water. Thus, the cooling unit 320 for cooling water stored in the tank 310 may not be necessary.

To this end, as illustrated in FIG. 4, an immersion member 22 may be positioned directly above the tank 310. As illustrated in FIG. 5, ice I produced in the immersion member 22 positioned directly above the tank 310 may be dropped and moved to the tank 310 due to weight thereof through an open upper portion of the tank 310. In this manner, the ice I moved to the tank 310 may be heat-exchanged with water stored in the tank 310 to cool the water stored in the tank 310 to produce cold water.

However, the configuration for supplying ice I produced in the ice making unit 20 to the tank 310 is not particularly limited and any other known configuration such as a configuration in which a guide member (not shown) is rotatably provided between an ice reservoir 200 and the tank 310 and ice I produced in the ice making unit 20 is moved to the ice reservoir 200 or the tank 310 by the guide member may also be adopted.

FIGS. 6 and 7 are views illustrating an ice making apparatus and an operation thereof according to another exemplary embodiment in the present disclosure.

An ice making apparatus 10 according to another exemplary embodiment is different from the ice making apparatus 10 described above with reference to FIGS. 1 through 3, in terms of components of the ice making unit 20. Thus, different components will be mainly described, and descriptions of other components may be replaced with those made above with reference to FIGS. 1 through 3.

The ice making unit 20 of the ice making apparatus 10 according to another exemplary embodiment may include a thermoelectric module 24, an immersion member 22, and an ice making tray 23 as illustrated in FIG. 6.

When power is applied to the thermoelectric module 24, heat may be transmitted from one side thereof to the other side thereof. Thus, one side of the thermoelectric module 24 may be cooled to become a cooling side and the other side thereof may be heated to become a heating side.

The configuration of the thermoelectric module 24 is not particularly limited and any other known configuration may be adopted as long as heat may be transmitted from one side to the other side when power is applied thereto.

The immersion member 22 may be connected to the thermoelectric module 24. As illustrated in FIG. 6, the immersion member 22 may be connected to the thermoelectric module 24 by a heat transmission member 27 having a plate-like shape. The heat transmission member 27 may be connected to one side of the thermoelectric module 24, that is, the cooling side thereof. Thus, when power is applied to the thermoelectric module 24, the immersion member 22 may be cooled.

Water may be supplied to the ice making tray 23 by a water supply pipe P connected to a water source and the immersion member 22 may be immersed therein. The ice making tray 23 may be rotated around a rotational shaft A to an ice making position as illustrated in FIG. 6 and water may be held therein.

In this state, when power is applied to the thermoelectric module 24, the cooling side of the thermoelectric module 24 may be cooled and the heating side thereof may be heated. Accordingly, the immersion member 22 connected to the cooling side of the thermoelectric module 24 is also cooled, and the immersion member 22 is heat-exchanged with water in which the immersion member 22 is immersed, to produce ice I in the immersion member 22.

When the ice I produced in the immersion member 22 has a predetermined size, the ice making tray 23 may be rotated around the rotational shaft A to an ice removing position as illustrated in FIG. 7. In this state, when power in a reverse direction is applied to the thermoelectric module 24, the cooling side of the thermoelectric module 24 may be heated and the heating side thereof may be cooled.

Accordingly, the immersion member 22 connected to the cooling side of the thermoelectric module 24 may be heated. Thus, the ice I produced in the immersion member 22 may be separated from the immersion member 22 and dropped due to weight thereof so as to be stored in the ice reservoir 200 as illustrated in FIG. 7.

Fin members 25 for releasing heat may be connected to the heating side of the thermoelectric module 24, and a cooling fan 26 may be provided in the fin members 25. When the cooling fan 26 is driven, air may flow between the fin members 25. Accordingly, heat dissipation may be more efficiently performed on the heating side of the thermoelectric module 24, and the thermoelectric module 24 may be smoothly operated.

As described above, when the ice storage apparatus and the ice making apparatus including the same according to exemplary embodiments in the present disclosure are used, noise transmitted externally when ice is moved from the ice making unit in which ice is produced to the ice reservoir in which ice is stored may be reduced, and a size and a shape of ice stored in the ice reservoir may not be easily changed.

The configurations of the ice storage apparatus and the ice making apparatus including the same according to the exemplary embodiments of the present disclosure described above are not limited in its application, but the entirety or a portion of the exemplary embodiments may be selectively combined to be configured into various modifications.

The invention claimed is:

1. An ice storage apparatus comprising:

a noise reduction unit;

a tank positioned within the noise reduction unit, wherein the tank is configured to store a liquid at a predetermined level; and an ice reservoir positioned within the tank, wherein the ice reservoir is configured to store ice produced by an ice making unit, and wherein noise created by the ice moving from the ice making unit to the ice reservoir is attenuated by the liquid stored in the tank.

2. The ice storage apparatus of claim 1, wherein the liquid is water.

3. The ice storage apparatus of claim 2, wherein the tank is a cold water tank in which cold water is stored.

4. The ice storage apparatus of claim 3, wherein the tank includes a cooling unit cooling water.

5. The ice storage apparatus of claim 3, wherein a portion of ice produced in the ice making unit is supplied to the tank to produce cold water.

6. An ice making apparatus comprising:

an ice making unit producing ice; and the ice storage apparatus of claim 1, storing ice produced by the ice making unit.

7. The ice making apparatus of claim 6, wherein the ice making unit comprises:

an evaporator in which a refrigerant flows;

an immersion member connected to the evaporator; and an ice making tray in which water is held to allow the immersion member to be immersed therein.

8. The ice making apparatus of claim 6, wherein the ice making unit comprises:

a thermoelectric module in which heat is transmitted from one side thereof to the other side thereof when power is applied thereto;

an immersion member connected to the thermoelectric module; and an ice making tray in which water is held to allow the immersion member to be immersed therein.

* * * * *